US008951068B2

(12) United States Patent
Tai

(10) Patent No.: US 8,951,068 B2
(45) Date of Patent: Feb. 10, 2015

(54) MODULAR CONNECTOR

(71) Applicant: Delta Electronics, Inc., Taoyuan Hsien (TW)

(72) Inventor: Chin-Chung Tai, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 66 days.

(21) Appl. No.: 13/856,207

(22) Filed: Apr. 3, 2013

(65) Prior Publication Data

US 2014/0120771 A1 May 1, 2014

(30) Foreign Application Priority Data

Oct. 29, 2012 (TW) ..... 101139885 A

(51) Int. Cl.

| | |
|---|---|
| ***H01R 13/66*** | (2006.01) |
| ***H01R 25/00*** | (2006.01) |
| ***H01R 12/52*** | (2011.01) |
| ***H01R 13/645*** | (2006.01) |
| ***H01R 13/658*** | (2011.01) |
| *H01R 24/64* | (2011.01) |

(52) U.S. Cl.

CPC ..... *H01R 13/658* (2013.01); *H01R 25/006* (2013.01); *H01R 12/52* (2013.01); *H01R 24/64* (2013.01); *H01R 13/645* (2013.01)

USPC ..... 439/620.18

(58) Field of Classification Search

CPC ..... H01R 23/025; H01R 13/65802

USPC ..... 439/620.18, 620.17, 620.23, 607.38

See application file for complete search history.

(56) References Cited

U.S. PATENT DOCUMENTS

| | | | | |
|---|---|---|---|---|
| 6,128,201 | A * | 10/2000 | Brown et al. | 361/784 |
| 6,169,593 | B1 | 1/2001 | Kanaya et al. | |
| 6,496,384 | B1 * | 12/2002 | Morales et al. | 361/784 |
| 6,612,871 | B1 | 9/2003 | Givens | |
| 7,025,635 | B2 | 4/2006 | Chang | |
| 7,510,441 | B2 * | 3/2009 | Zhang et al. | 439/620.18 |
| 8,579,660 | B2 * | 11/2013 | Chow et al. | 439/607.01 |
| 2008/0305680 | A1 | 12/2008 | Little et al. | |

FOREIGN PATENT DOCUMENTS

| | | | |
|---|---|---|---|
| JP | 2008-52987 | A | 3/2008 |
| JP | 2011-129534 | A | 6/2011 |
| TW | 353858 | | 3/1999 |
| TW | 560743 | U | 11/2003 |
| TW | M244606 | U | 9/2004 |
| TW | I276865 | | 3/2007 |
| TW | 200952267 | | 12/2009 |
| TW | M393067 | U1 | 11/2010 |

* cited by examiner

*Primary Examiner* — Phuongchi T Nguyen

(74) *Attorney, Agent, or Firm* — Muncy, Geissler, Olds & Lowe, P.C.

(57) ABSTRACT

A modular connector includes a housing, a first circuit board, a first pin set, a second pin set and a second circuit board. The housing includes a first hole and a second hole. The first pin set is extended into the first hole and electrically connected to the first circuit board. The second pin set is extended into the second hole and electrically connected to the second circuit board. The second circuit board is perpendicularly connected to the first circuit board.

11 Claims, 5 Drawing Sheets

MODULAR CONNECTOR

CROSS REFERENCE TO RELATED APPLICATIONS

This Non-provisional application claims priority under 35 U.S.C. §119(a) on Patent Application No(s). 101139885 filed in Taiwan, Republic of China on Oct. 29, 2012, the entire contents of which are hereby incorporated by reference.

BACKGROUND OF THE INVENTION

1. Field of Invention

The invention relates to a connector and, in particular, to a modular connector.

2. Related Art

With the progress of technologies, the current electronic apparatuses are mostly manufactured with miniaturization and more functions. Besides, for the data transmission between different kinds of electronic apparatuses, several different communication protocols and the connectors thereof are developed for connecting the electronic apparatuses and achieving their data transmission. Recently, the connector mostly used in the network interface is a connector with a twisted pair of wires, which can be divided into two kinds of a RJ-45 connector and a RJ-11 connector.

Since the electronic apparatus has been gradually developed with multiple and smart functions, the amount of signal that needs to be transmitted in the whole system is greatly increased. However, at the same time, the electronic components and products will be developed with the lightness and miniaturization. Accordingly, for the requirements of heavy signal transmission and miniaturization, the RJ connector applied to the high-frequency transmission is made with more pins and smaller size.

When the signal is transmitted to the circuit of the RJ connector, signal skew will occur and is always a problem, which is caused by the different transmission lengths of the signal pair so that the times of arriving at a receiving end are different. Hence, in order to decrease the signal skew, the circuit layout is designed that the transmission lengths of the signals are as close as possible. However, due to the structural or manufacturing factor, the current RJ connector is incapable of this technical effectiveness.

SUMMARY OF THE INVENTION

In view of the foregoing subject, an objective of the invention is to provide a modular connector that can effectively decrease the signal skew of the of signal pair.

To achieve the above objective, a modular connector according to the invention includes a housing, a first circuit board, a first pin set, a second pin set and a second circuit board. The housing includes a first hole and a second hole. The first pin set is extended into the first hole and electrically connected to the first circuit board. The second pin set is extended into the second hole and electrically connected to the second circuit hoard. The second circuit board is perpendicularly connected to the first circuit board.

In one embodiment, the first circuit board includes a first circuit layer, a second circuit layer and a first blocking layer, the first circuit layer is electrically connected to the first pin set, the second circuit layer is electrically connected to the second pin set, and the first blocking layer is disposed between the first and second circuit layers.

In one embodiment, the second circuit board includes a third circuit layer, a fourth circuit layer and a second blocking layer, the third circuit layer is electrically connected to the first and second circuit layers, the fourth circuit layer is electrically connected to the first and second circuit layers, and the second blocking layer is disposed between the third and fourth circuit layers.

In one embodiment, the modular connector further comprises a connection element which is electrically connected to the first and second blocking layers.

In one embodiment, the modular connector further comprises a base disposed parallel with the first circuit board on a side of the second circuit board and perpendicular to the second circuit board, and electrically connected to the second circuit board. The base has a plurality of first identification structures, and the housing has a plurality of second identification structures corresponding to the first identification structures. The first identification structures are stacked in a row but not aligned with each other. Each of the first identification structures has an indentation disposed at a root portion thereof. Each of the first identification structures has a bar-shaped protrusion, or has a rectangular, triangular or circular structure. Each of the second identification structures has a blocked hole, or has a rectangular, triangular or circular hole.

In one embodiment, the modular connector further comprises a shielding disposed between the second circuit board and the base.

In one embodiment, the modular connector further comprises a plurality of conductive elements electrically connected to the first and second circuit boards.

In one embodiment, the first, second, third and fourth circuit layers include a plurality of electronic devices, which are of the surface mount technology (SMT) type.

In one embodiment, the first and second pin sets are disposed on the first circuit board by the surface mount technology (SMT).

In one embodiment, a plurality of electronic devices disposed on the third and fourth circuit layers have heights less than 6 μm.

In one embodiment, the first circuit board has a first opening located in the middle of a side of the first circuit board, and the first and second circuit boards are assembled with each other perpendicularly through the first opening. The second circuit board has a second opening located in the middle of a side of the second circuit board corresponding to the first opening.

As mentioned above, for the modular connector according to the invention, the first opening is disposed in the middle of a side of the first circuit board, the second opening is disposed in the middle of a side of the second circuit board, and the circuit layout of the first circuit board is symmetric according to the first opening. Thereby, the signal skew of the signal pair can be decreased. Besides, the first circuit layer, the second circuit layer and the first blocking layer are integrated to the first circuit board, so that the cost is decreased and the modularization level is also increased. Furthermore, by respectively disposing the first and second identification structures to the base and housing, the cost of making the mold of the housing can be decreased because only one mold is required and able to be applied to various bases, and the differentiation can be easily achieved.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
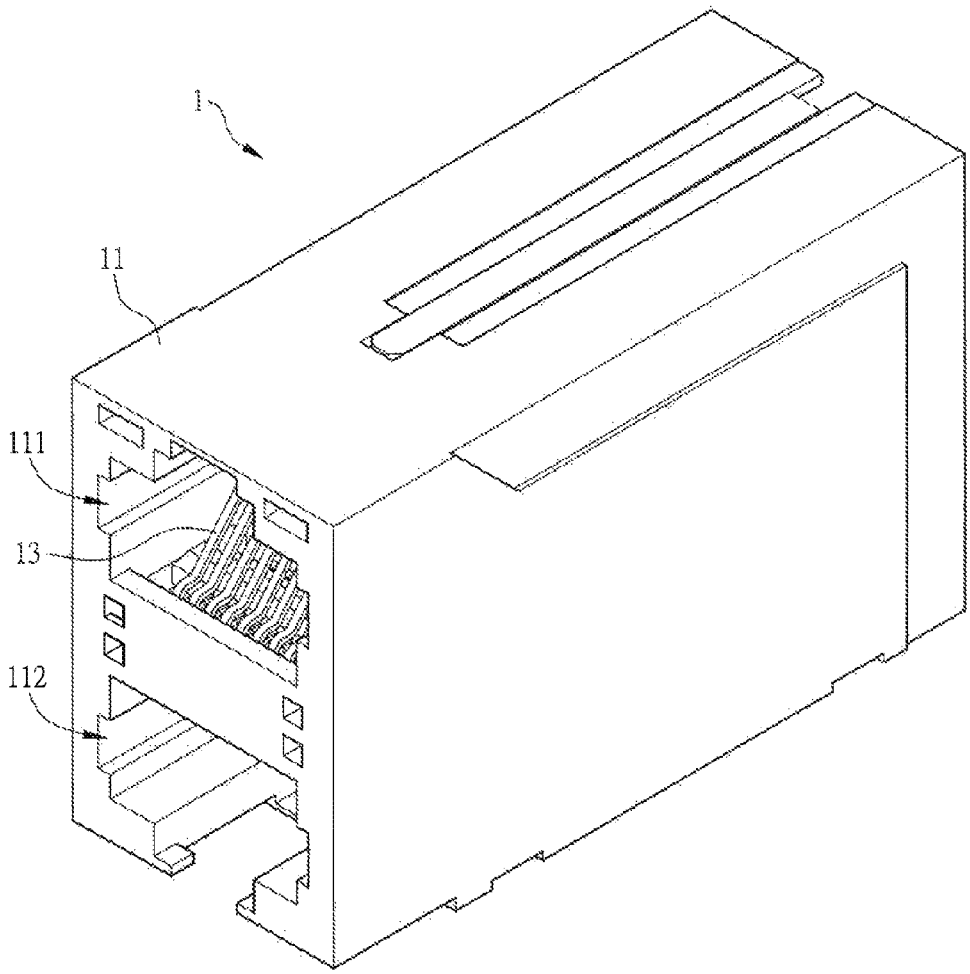
FIG. 1A is a schematic diagram of a modular connector according to a preferred embodiment of the invention.
Figure 1B:
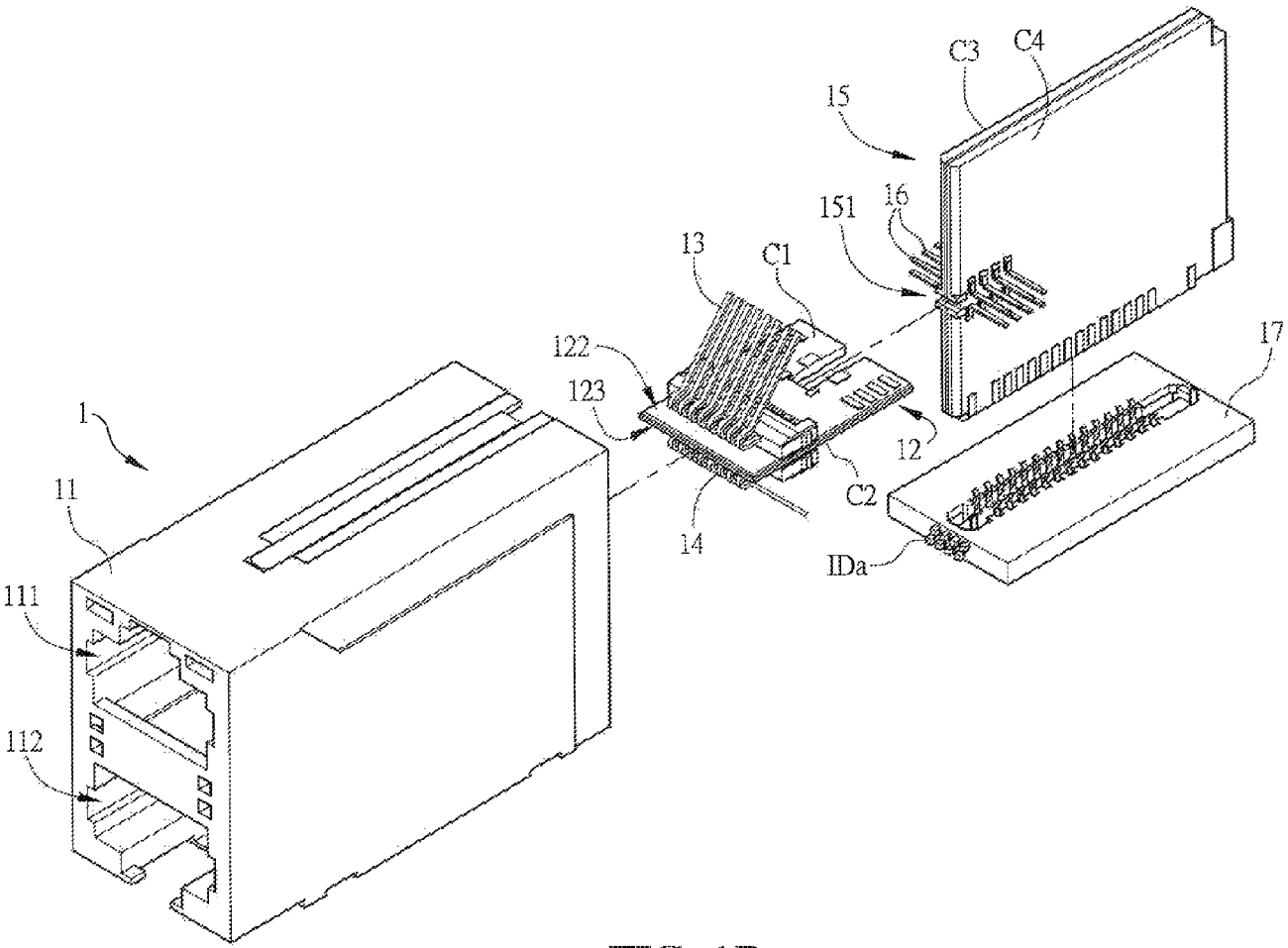
FIG. 1B is an exploded diagram of the modular connector shown in FIG. 1A.
Figure 2:
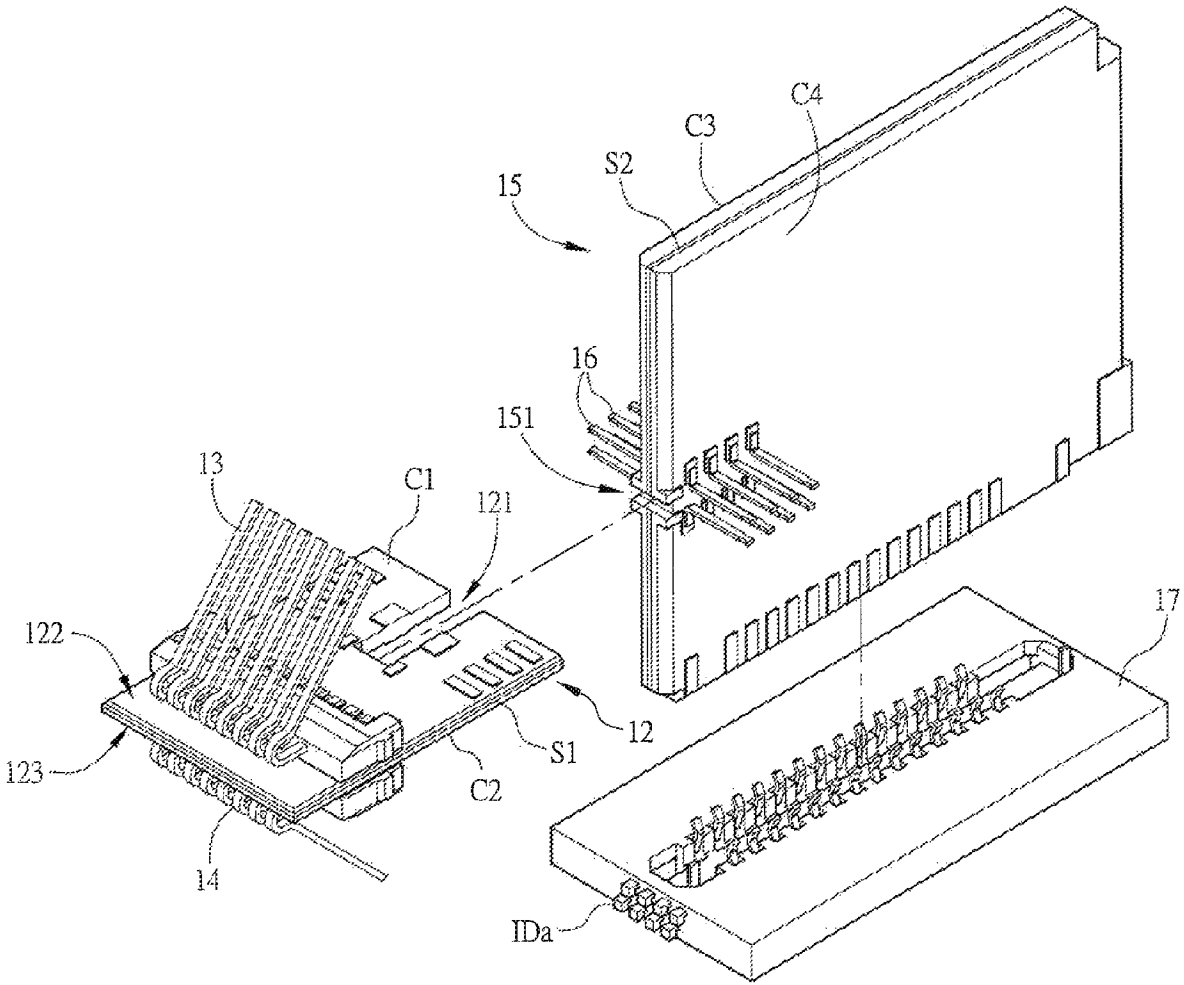
FIG. 2 is a schematic diagram showing partially exploded structure of the modular connector shown in FIG. 1A.

FIG. 1A is a schematic diagram of a modular connector 1 according to a preferred embodiment of the invention, FIG. 1B is an exploded diagram of the modular connector 1, and FIG. 2 is a schematic diagram showing partially exploded structure of the modular connector 1. For example, the modular connector 1 is applied to the network communication, and can be the type of RJ-45, RJ-11, RJ-12, etc. according to the applications of different bandwidths. The modular connector 1 includes a housing 11, a first circuit board 12, a first pin set 13, a second pin set 14, a second circuit board 15 and a plurality of conductive elements 16.

The housing 11 can prevent its internal circuit from being damaged and being contacted by the user. Therefore, it can be made by plastic material or other insulating material via injection molding. The housing 11 has a first hole 111 and a second hole 112 both for allowing the plug (not shown) of a transmission cable to be inserted therein. The first and second holes 111 and 112 are stacked along a vertical direction. The number of the holes can be changed according to the practical requirements.

The first circuit board 12 can be a printed circuit board (PCB), and has a first opening 121, a first surface 122 and a second surface 123. The first opening 121 is located in the middle of a side of the first circuit board 12. The first surface 122 and the second surface 123 are disposed oppositely. To be noted, in other embodiments, the first opening of the first circuit board is unnecessary.

The first pin set 13 is disposed on the first surface 122 of the first circuit board 12, and is electrically connected to the first circuit board 12. The first pin set 13 is disposed on the first surface 122 by the surface mount technology (SMT) for decreasing the total thickness of the first pin set 13 and the first circuit board 12. The first pin set 13 includes a plurality of first pins. Regarding the RJ-45 connector, there are eight first pins, but this invention is not limited thereto. The first pin set 13 is extended into the first hole 111 for electrically connecting to the plug (not shown) of a transmission cable.

The second pin set 14 is disposed on the second surface 123 of the first circuit board 12, and is electrically connected to the first circuit board 12. The second pin set 14 is disposed on the second surface 123 by the surface mount technology (SMT) for decreasing the total thickness of the second pin set 14 and the first circuit board 12. The second pin set 14 includes a plurality of second pins. Regarding the RJ-45 connector, there are eight second pins, but this invention is not limited thereto. The second pin set 14 is extended into the second hole 112 for electrically connecting to the plug (not shown) of a transmission cable.

The second circuit board 15 can be a printed circuit board (PCB) and is connected to the first circuit board 12 through the first opening 121.

In this embodiment, for securely assembling the first and second circuit boards 12 and 15, the second circuit board 15 can have a second opening 151 located in the middle of a side of the second circuit board 15 corresponding to the first opening 121. Hence, the first circuit 12 and the second circuit board 15 can be engaged with each other for the tight connection. To be noted, in other embodiments, the second opening of the second circuit board is unnecessary.

The conductive elements 16 are electrically connected to the first and second circuit boards 12 and 15. The conductive elements 16 can be L-shaped pins.

Furthermore, the first circuit board 12 includes a first circuit layer C1, a second circuit layer C2 and a first blocking layer S1. The first circuit layer C1 is disposed on the first surface 122 and electrically connected to the first pin set 13 so that the signal can be transmitted between the first pin set 13 and the first circuit layer C1. The second circuit layer C2 is disposed on the second surface 123 and electrically connected to the second pin set 14 so that the signal can be transmitted between the second pin set 14 and the second circuit layer C2. Besides, the first circuit layer C1 can be divided into two symmetric circuit layouts along the extending direction of the first opening 121, and so is the second circuit layer C2.

The first blocking layer S1 is disposed between the first and second circuit layers C1 and C2, and can decrease the mutual interference of the first and second circuit layers C1 and C2 during the operation. As an embodiment, the first blocking layer S1 can be made by metal, such as copper, for effectively blocking the electromagnetic wave generated during the operation of the circuits.

The second circuit board 15 includes a third circuit layer C3, a fourth circuit layer C4 and a second blocking layer S2. The third circuit layer C3 is electrically connected to the first and second circuit layers C1 and C2, and the fourth circuit layer C4 is electrically connected to the first and second circuit layers C1 and C2.

The second blocking layer S2 is disposed between the third and fourth circuit layers C3 and C4, and can decrease the mutual interference of the third and fourth circuit layers C3 and C4 during the operation. As an embodiment, the second blocking layer S2 can be made by metal, such as copper, for effectively blocking the electromagnetic wave generated during the operation of the circuits.

To be noted, because the first opening 121 is located in the middle of a side of the first circuit hoard 12, the second opening 151 is located in the middle of a side of the second circuit board 15, and the first circuit layer C1 is divided into two symmetric circuit layouts along the extending direction of the first opening 121, the transmission lengths of all signals on the first circuit layer C1 are substantially the same when the first and second circuit boards 12 and 15 are assembled and electrically connected to each other. Therefore, the signal skew of the signal pair can be decreased, and it is the same as that of the second circuit layer C2.

Besides, for electrically connecting the first and second blocking layers S1 and S2, the connector 1 can further include a connection element (not shown), such as a connection sheet, which can electrically connect to the first and second blocking layers S1 and S2. As an embodiment, the connection element can be made by the same material (e.g. copper) as the first and second blocking layers S1 and S2. Otherwise, the material of the connection element can be different from that of the first blocking layer S1 or second blocking layer S2.

Additionally, in this embodiment, the first, second, third and fourth circuit layers C1 to C4 can each include a plurality of electronic devices (not shown). These electronic devices can be of the SMT type, and that is, the electronic devices are disposed on each of the circuit layers by SMT for decreasing the total thickness of the first and second circuit boards 12 and 15. Preferably, the height of the electronic device is less than 6 μm, and can be 5.5 μm or 5 μm for example. However, this invention is not limited thereto.

The connector 1 can further include a base 17, which is parallel with the first circuit board 12 and disposed on a side of the second circuit board 15 and perpendicular to the second circuit board 15. For example, the base 17 is disposed under the second circuit board 15 and adjacent to a side of the first circuit board 12. The terminals of the second circuit board 15 are electrically connected to the contacts of the base 17, and then electrically connected to a mother circuit board (not shown) through the terminals of the base 17. For example, the mother circuit board can transmit the signal to an electronic apparatus (not shown) through the second circuit board 15, the conductive elements 16, the first circuit layer C1, the first pin set 13 and a transmission cable. On the contrary, the electronic apparatus can transmit the signal to the mother circuit board through the transmission cable, the first pin set 13, the first circuit layer C1, the conductive elements 16 and the second circuit board 15.

In this embodiment, for decreasing the mutual interference between the mother circuit board and the first circuit board 12 or second circuit board 15 during the operation, the connector 1 can further include a shielding (not shown) disposed between the second circuit board 15 and the base 17. As an embodiment, the shielding can be made by copper or other metal for blocking the electromagnetic wave generated during the operation.

In this embodiment, for facilitating the assembly of the base 17 and the housing, the base 17 can have a plurality of first identification structures IDa, and the housing 11 can further have a plurality of second identification structures (not shown) corresponding to the first identification structures IDa.

Figure 3A:
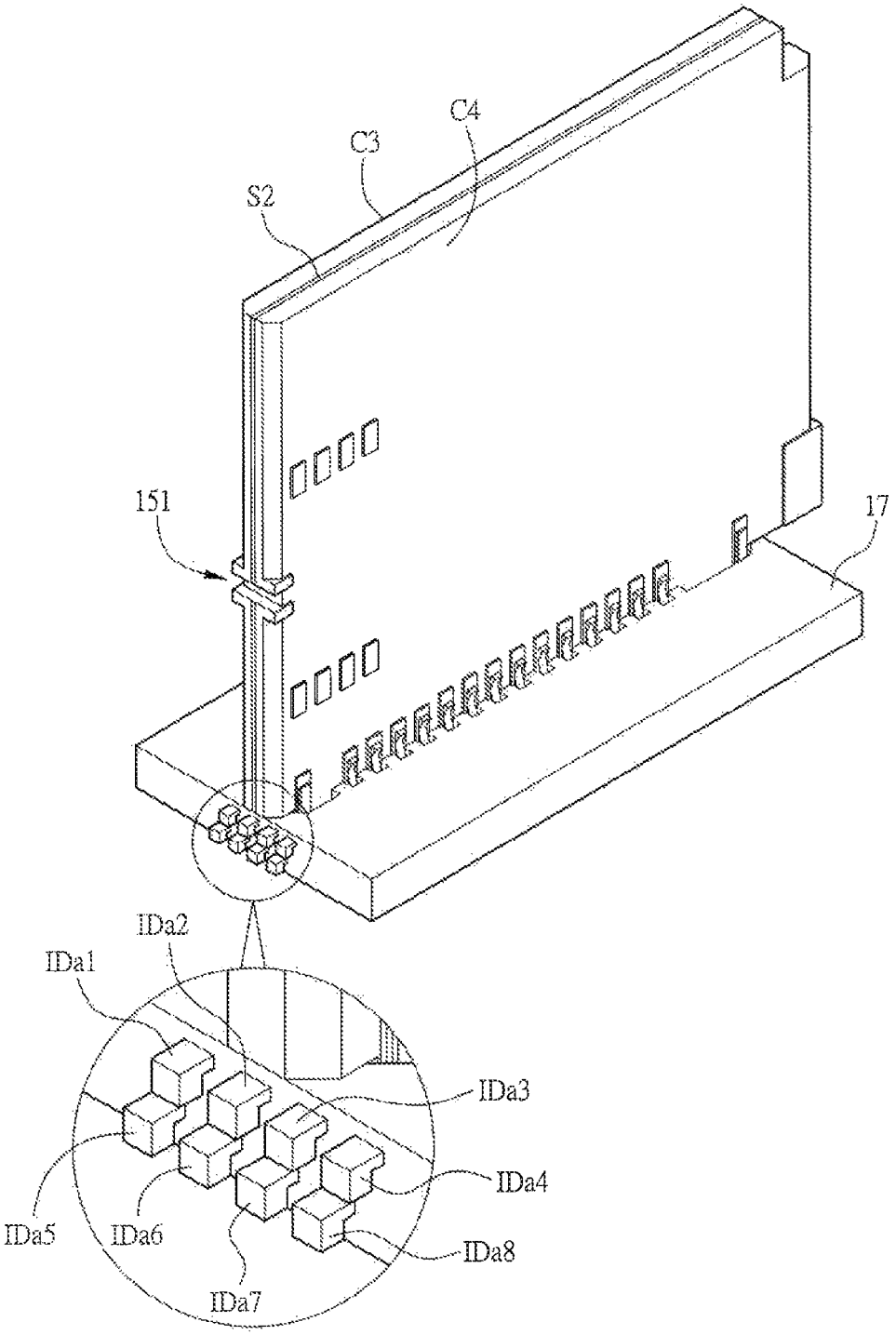
FIG. 3A is an enlarged diagram showing the partial structure of the base according to a preferred embodiment of the invention.
Figure 3B:
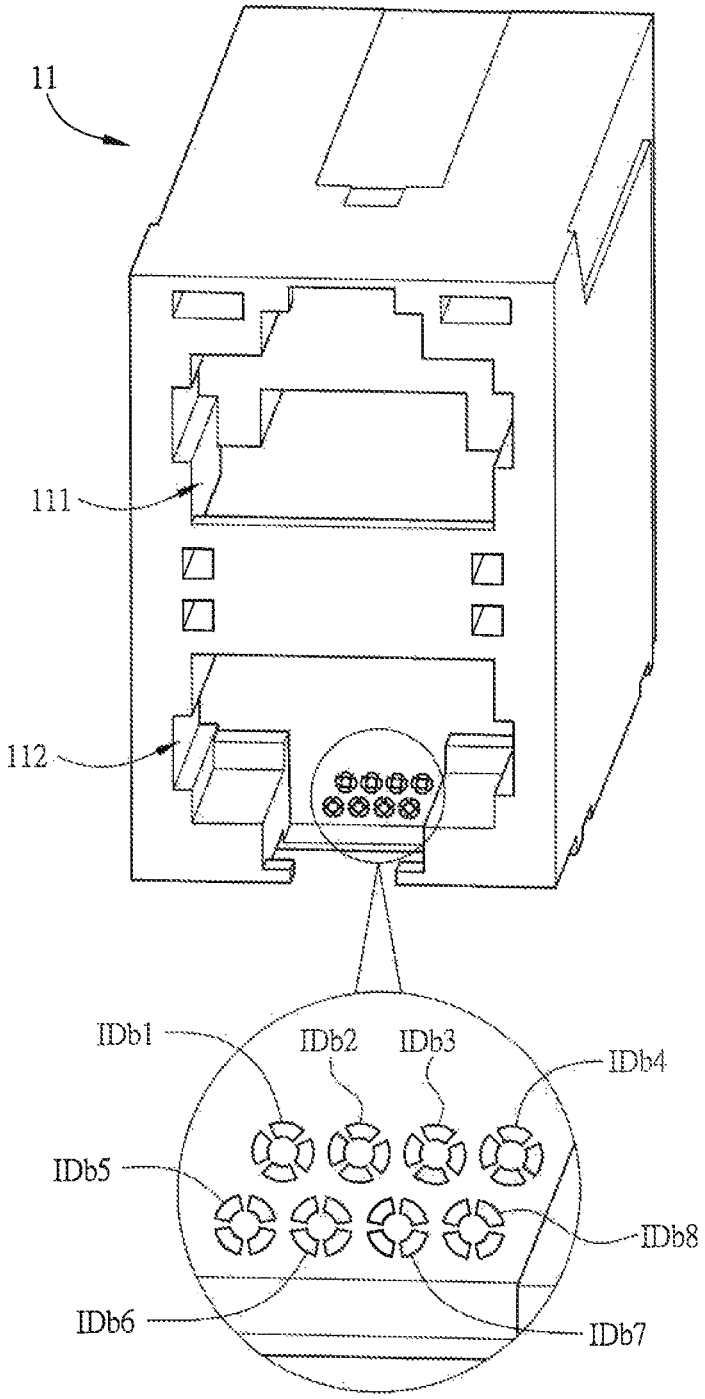
FIG. 3B is an enlarged diagram showing the partial structure of the housing according to a preferred embodiment of the invention.

FIG. 3A is an enlarged diagram showing the partial structure of the base 17, and FIG. 3B is an enlarged diagram showing the partial structure of the housing 11. As shown in FIG. 3A, the base 17 includes a plurality of first identification structures IDa1~IDa8, which can be a protrusion and shaped like a bar. At least one of the first identification structures can be cut off by a tool (e.g. scissors) according to the requirements. In other words, cutting off different first identification structures can make different combinations of the remaining first identification structures for achieving the identification. In this embodiment, two rows of the first identification structures are not aligned with each other, and this will facilitate the injection molding process. In FIG. 3A, the root portion of each of the first identification structures has an indentation through which the first identification can be easily removed manually. The first identification structure can have a rectangular, triangular, circular or other geometric structure.

As shown in FIG. 3B, the housing 11 includes a plurality of second identification structures IDb1 to IDb8, which can be blocked holes. The second identification structures IDb1 to IDb8 can be optionally excavated by a tool (e.g. scissors) according to the combination of the first identification structures for achieving the identification. The second identification structure can be a rectangular, triangular, circular, or other geometric hole.

For example, when the first identification structures IDa1, IDa3 and IDa8 of the base 17 are cut off, the second identification structures IDb2, IDb4~IDb7 of the housing 11 are correspondingly excavated. Thereby, the base 17 and the housing 11 can match with each other during the assembly, and will not be confused with other models, for achieving the identification.

In summary, the present invention provides the modular connector, wherein the first opening is located in the middle of a side of the first circuit board, the second opening is located in the middle of a side of the second circuit board, and the circuit layout of the first circuit board is symmetric according to the first opening. Thereby, the signal skew of the signal pair can be decreased. Besides, the first circuit layer, the second circuit layer and the first blocking layer are integrated onto the first circuit board so that the cost is decreased and the modularization level is also increased. Furthermore, by the first and second identification structures respectively disposed on the base and housing, the cost of making the mold of the housing can be decreased because only one mold is required and able to be applied to various bases, and the differentiation can be easily achieved.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A modular connector, comprising:

a housing having a first hole and a second hole;

a first circuit board;

a first pin set electrically connected to the first circuit board and extended into the first hole;

a second pin set electrically connected to the first circuit board and extended into the second hole; and a second circuit board connected to the first circuit board perpendicularly;

wherein the first circuit board includes a first circuit layer, a second circuit layer and a first blocking layer, the first circuit layer is electrically connected to the first pin set, the second circuit layer is electrically connected to the second pin set, and the first blocking layer is disposed between the first and second circuit layers;

wherein the second circuit board includes a third circuit layer, a fourth circuit layer and a second blocking layer, the third circuit layer is electrically connected to the first and second circuit layers, the fourth circuit layer is electrically connected to the first and second circuit layers, and the second blocking layer is disposed between the third and fourth circuit layers;

wherein a connection element electrically connected to the first and second blocking layers;

wherein the first, second, third and fourth circuit layers include a plurality of electronic devices, which are of the surface mount technology (SMT) type;

wherein a base disposed parallel with the first circuit board, on a side of the second circuit board and perpendicular to the second circuit board, and electrically connected to the second circuit board;

wherein the base has a plurality of first identification structures, and the housing has a plurality of second identification structures corresponding the first identification structures.

2. The modular connector as recited in claim 1, wherein the first identification structures are stacked in a row but not aligned with each other.

3. The modular connector as recited in claim 1, wherein each of the first identification structures has an indentation disposed at a root portion thereof.

4. The modular connector as recited in claim 1, wherein each of the first identification structures has a bar-shaped protrusion, or has a rectangular, triangular or circular structure.

5. The modular connector as recited in claim 1, wherein each of the second identification structures has a blocked hole, or has a rectangular, triangular or circular hole.

6. The modular connector as recited in claim 1, further comprising: a shielding disposed between the second circuit board and the base.

7. The modular connector as recited in claim 1, further comprising:

a plurality of conductive elements electrically connected to the first and second circuit boards.

8. The modular connector as recited in claim 1, wherein the first and second pin sets are disposed on the first circuit board by the surface mount technology (SMT).

9. The modular connector as recited in claim 1, wherein a plurality of electronic devices disposed on the third and fourth circuit layers have heights less than 6 μm.

10. The modular connector as recited in claim 1, wherein the first circuit board has a first opening located in the middle of a side of the first circuit board, and the first and second circuit boards are assembled with each other perpendicularly through the first opening.

11. The modular connector as recited in claim 10, wherein the second circuit board has a second opening located in the middle of a side of the second circuit board corresponding to the first opening.

* * * * *